US005086640A

United States Patent [19]

Nagata et al.

[11] Patent Number: 5,086,640

[45] Date of Patent: Feb. 11, 1992

[54] METHOD OF DETECTING BREAKAGE OF A BEAD OF FLUID MATERIAL

[75] Inventors: Tsuyoshi Nagata, Osaka; Shinji Okuda, Hyogo, both of Japan

[73] Assignee: Sunstar Engineering Inc., Osaka, Japan

[21] Appl. No.: 620,005

[22] Filed: Nov. 30, 1990

[30] Foreign Application Priority Data

Nov. 30, 1989 [JP] Japan ..... 1-312298

[51] Int. Cl.[5] ..... B05D 1/26; G08D 21/00

[52] U.S. Cl. ..... 73/661; 73/19.03; 156/356; 340/683; 118/712; 222/380; 222/23; 427/8

[58] Field of Search ..... 73/19.03, 661, 572; 156/356; 340/683; 118/712; 222/380, 61, 52, 23; 427/8

[56] References Cited

U.S. PATENT DOCUMENTS 4,330,354 5/1982 Deubner et al. ..... 118/712
4,666,732 5/1987 Schucker ..... 118/712
4,935,261 6/1990 Srivastava et al. ..... 222/61

*Primary Examiner*—Hezron E. Williams
*Assistant Examiner*—Rose M. Finley
*Attorney, Agent, or Firm*—Birch, Stewart, Kolasch & Birch

[57] ABSTRACT

A method of detecting breakage or breakage of a continuous bead of fluid material, for example, a coating material, during the discharge thereof from an applicator nozzle, which comprises the steps of providing the applicator nozzle with a vibration sensor operable to detect vibrations occuring in the applicator nozzle and to generate a vibration signal, indicative of the detected vibration. The vibration signal undergoes a change in level when the vibrations are actually detected by the vibration sensor and the change in level of the vibration signal is compared with a reference amplitude level. Only when the amplitude level of the vibration signal exceeds the reference amplitude level, the change in amplitude level of the vibration signal provides an indication of the actual occurrence of the vibrations in the applicator nozzle.

2 Claims, 3 Drawing Sheets

METHOD OF DETECTING BREAKAGE OF A BEAD OF FLUID MATERIAL

BACKGROUND OF THE INVENTION

1. Field of the Invention

The present invention relates to a method of detecting breakage or disruption of a continuous bead of fluid material during the discharge thereof from an applicator nozzle.

The fluid material utilizable in the practice of the present invention includes, for example, a viscous bonding agent, a viscous coating material, a sealing material or any other viscous material desired to be applied to a work by the use of an applicator nozzle which forms a continuous bead of such material as the latter is discharged from the applicator nozzle.

2. Description of the Prior Art

When it comes to the application of a fluid material, for example, a sealing material, to a work with the use of an applicator of a type having a nozzle, it is a general practice to supply the sealing material under pressure from a storage tank or reservoir towards the nozzle by means of a pump so that a stream of sealing material discharged from the nozzle can eventually form a continuous bead of sealing material on the work. In a certain application, the applicator nozzle is driven along a predetermined path by a computer-assisted manipulator to apply the continuous bead of sealing material to the work so as to fill up a gap having a substantial length. In another application, the applicator nozzle may be manually moved along the predetermined path conforming to the length of the gap in the work.

As the sealing material is consumed for the actual application to the work, the amount of sealing material within the storage tank decreases quite naturally and, in such case, the storage tank has to be replenished with an amount of sealing material. Depending on the type of sealant supply system including the storage tank, the nozzle and a supply tubing leading from the storage tank to the nozzle via the pump, it is often experienced that the failure to remove gases from the pumping system when the storage tank is to be replenished may result in an intrusion of air into the sealing material being pumped through the supply tubing towards the applicator nozzle. This problem may also occur even when the pump is driven when and after the storage tank has been emptied.

When air intrudes into the sealing material being supplied under pressure, the air is compressed within the system together with the sealing material being supplied under pressure while forming air bubbles and, subsequently, expands with the air bubbles consequently ruptured as the sealing material is discharged from the applicator nozzle. This phenomenon tends to bring about a problem in that the sealing material being discharged from the applicator nozzle is discontinued, resulting in a disruption or breakage of a continuous bead of sealing material being deposited on, or otherwise applied to, the work.

The breakage of the continuous bead of sealing material hampers accomplishment of an objective desired of applying the sealing material, or any other fluid material, resulting in a defective sealing or bonding which in turn results in the production of the work which is generally deemed defective.

No attempt has hitherto been made to minimize the above discussed problems by the detection of an occurrence of the breakage or disruption of the continuous bead of fluid material discharged from the applicator nozzle. Therefore, the occurrence of the breakage or disruption of the bead of fluid material emerging from the applicator nozzle has imposed a limitation on the quality of the work to which the fluid material has been applied, coated or otherwise deposited, and/or the yield of the works. It has also constituted a cause of reduction in reliability of automatic application, coating or deposition performed by the computer-assisted manipulator or robot.

SUMMARY OF THE INVENTION

The present invention has been devised with a view to substantially eliminating or minimizing the above discussed problems and has for its essential object to provide a novel method of detecting a breakage of a bead of fluid material discharged from an applicator nozzle, which would occur as a result of ingress of air into the fluid material being supplied under pressure.

According to the present invention, the above described objective can be accomplished by the provision of the applicator nozzle with a vibration sensor operable to provide a vibration signal representative of vibrations occurring in the applicator nozzle, an occurrence of the breakage of the bead of the fluid material being indicated by a change of the vibration signal.

It is to be noted that, when the fluid material flows through the applicator nozzle and/or the fluid material is discharged from the applicator nozzle, a slight vibration is induced in the applicator nozzle. However, when the compressed air mixed up in the fluid material abruptly expands as the fluid material is discharged from the applicator nozzle, a vibration of relatively high amplitude will occur in the applicator nozzle.

Accordingly, when the amplitude of the vibration signal detected from the applicator nozzle is compared with a predetermined level set by a reference level generator, and an indication of the occurrence of the breakage of the bead of fluid material can be provided only when the amplitude of the vibration signal exceeds the predetermined level.

BRIEF DESCRIPTION OF THE DRAWINGS

In any event, the present invention will become more clearly understood from the following description of a preferred embodiment thereof, when taken in conjunction with the accompanying drawings. However, the embodiment and the drawings are given only for the purpose of illustration and explanation, and are not to be taken as limiting the scope of the present invention in any way whatsoever, which scope is to be determined solely by the appended claims. In the accompanying drawings, like reference numerals are used to denote like parts throughout the several views, and:

DETAILED DESCRIPTION OF THE EMBODIMENT

While the present invention is applicable to the application of any fluid material including, for example, a viscous bonding agent, a viscous coating material, a sealing material or any other viscous material desired to be applied to a work by the use of an applicator nozzle which forms a continuous bead of such material as the latter is discharged from the applicator nozzle, the detailed description of the present invention which follows will be directed to the application of a coating material for the purpose of facilitating a better understanding of the present invention.

Figure 1:
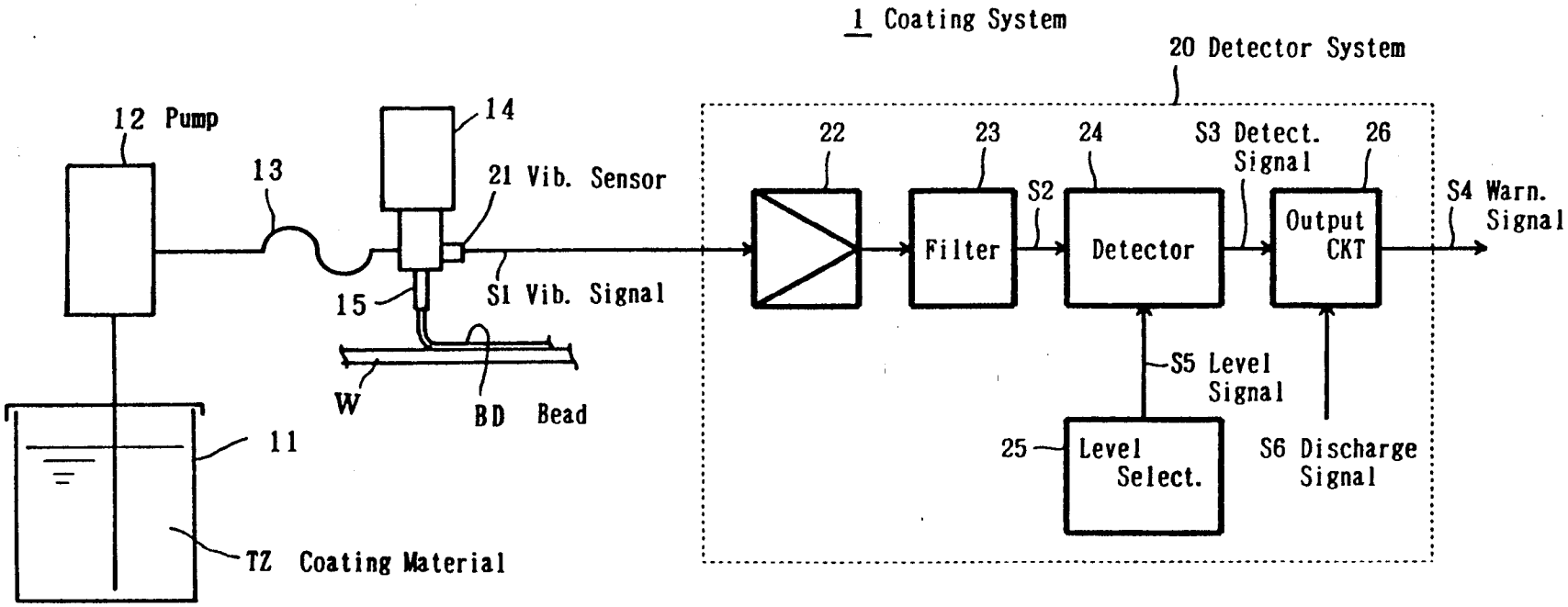
FIG. 1 is a block circuit diagram showing a coating system embodying the present invention.

Referring now to FIG. 1, a coating system shown therein and generally identified by 1 comprises a storage tank 11 for accommodating a mass of fluid coating material TZ, a pump 12 having a piston movable reciprocally in a direction longitudinally thereof for pumping the coating material TZ therethrough to a supply tubing 13, an applicator gun 14 fluid-connected with the supply tubing 13 and having an applicator nozzle 15, and a vibration sensor 21 mounted on the applicator gun 14 in the vicinity of the applicator nozzle 15. The applicator gun 14 may be of a type either moved manually along a predetermined path along which a bead BD of coating material is desired to be applied, or carried by a computer-assisted manipulator which moves the applicator gun 14 along the predetermined path according to a programmed scheme.

The vibration sensor 21 carried by the applicator gun 14 is electrically connected with a detector system 20 for detecting an occurrence of breakage of the bead BD of the coating material discharged from the applicator nozzle 15. This detector system 20 comprises an amplifier 22 for amplifying an electric vibration signal S1 outputted from the vibration sensor 21; a low-pass filter 23 operable to permit the passage therethrough of a low frequency component of the vibration signal S1; a detector 24, which may be employed in the form of a comparator, for comparing a low frequency vibration signal S2, outputted from the low-pass filter 23, with a reference level signal S5, supplied from a reference level selector 25, to determined if the low frequency vibration signal S2 is higher than a reference level selected by the reference level selector 25 and also for subsequently outputting a detection signal S3 in the event that the low frequency vibration signal S2 is higher than the reference level; and an output circuit 26 operable in response to the detection signal S3 from the detector 24 to output a warning signal S4 only during a period in which a discharge signal S6 indicative of an operating condition of the applicator gun 14 as will be described later.

The warning signal S4 outputted from the output circuit 26 is indicative of the actual occurrence of breakage of the bead BD of coating material discharged from the applicator nozzle 15 and may be employed to provide an audio and/or visual indication of the occurrence of the bead breakage through any suitable audio/visual indicator and/or to halt the applicator system.

The pump 12 is of a fluid-operated type utilizing a compressed air supplied from any suitable source of compressed air for driving the pump piston and is used to supply the coating material TZ under pressure from the storage tank 11 therethrough to the applicator gun 14 by way of the supply tubing 13. The coating material supplied to the applicator gun 14 can be discharged outwardly from the applicator nozzle 15. When and so long as the applicator gun 14 is moved along a predetermined path on a work K by means of, for example, a computer-assisted manipulator (not shown) while the applicator gun 14 is activated, the coating material discharged outwardly from the applicator nozzle 15 forms the continuous bead BD of coating material on a surface of the work W.

Where the coating material being supplied under pressure is mixed up with air, the air in the coating material is compressed together with the coating material being supplied under pressure and, therefore, the air will expand abruptly at a discharge port of the applicator nozzle 15 as the coating material is discharged outwardly from the applicator nozzle 15. The abrupt expansion of the air results in a temporarily discontinued discharge of the coating material from the applicator nozzle 14 accompanied by a breakage of the continuous bead BD of coating material.

The vibration sensor 21 carried by the applicator gun 14 and positioned in the vicinity of the applicator nozzle 15 converts vibrations, applied to or otherwise induced in the applicator nozzle 15, into the vibration signal S1. This vibration sensor 21 may be of a type utilizing, for example, a piezoelectric sensor element. For this purpose, the vibration sensor 21 is operable to detect a vibration which would occur when the applicator gun 14 is selectively activated and deactivated, a vibration induced by the normal flow of the coating material TZ and/or a vibration induced by the abrupt expansion of the compressed air during the discharge of the coating material TZ from the applicator nozzle 15.

The details of the applicator gun 14 will now be described with particular reference to FIG. 3. As shown therein, the applicator gun 14 comprises a gun body 50 including upper and lower gun blocks 51 and 52 rigidly coupled with each other and positioned one above the other. The upper gun block 51 comprises a pneumatic cylinder 53 including a cylinder housing 54 having a piston 55 reciprocally movably accommodated therein, said cylinder housing 54 having upper and lower chambers defined therein on respective sides of the piston 55. The upper chamber of the cylinder housing 54 is communicated to the atmosphere through a vent port 62 while the lower chamber of the cylinder housing 54 is fluid connected with the source of compressed air through an air supply port 63.

Figure 3:
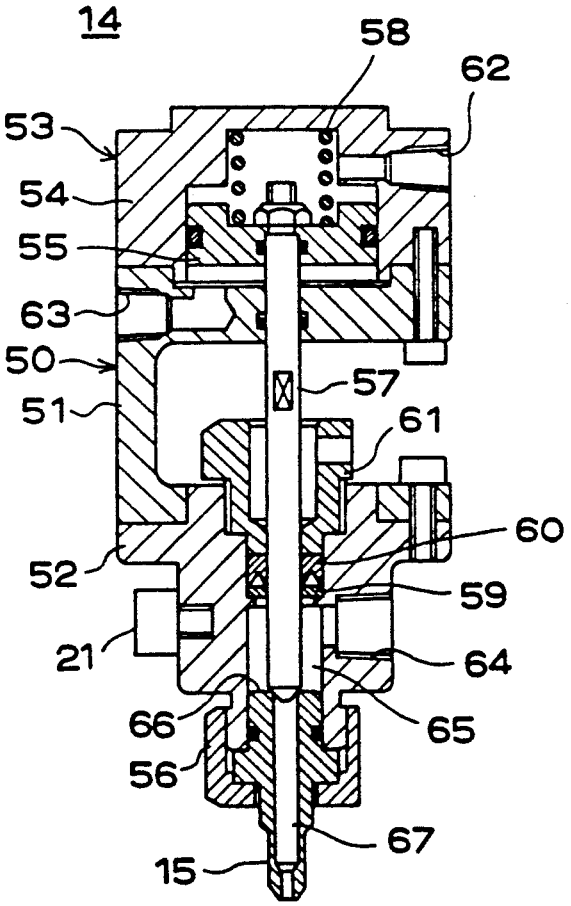
FIG. 3 is a longitudinal sectional view of a coating gun used in the coating system in applying a fluid coating material to a work.

This upper gun block 51 also comprises a compression spring 58 accommodated within the upper chamber of the cylinder housing 54 for biasing the piston 55 in one direction to a downwardly shifted position as viewed in FIG. 3. On the other hand, the lower gun block 52 comprises a valve rod 57 drivingly coupled at an upper end with the piston 55 within the cylinder housing 54 for movement together therewith in a direction axially thereof, a ring plate 59 mounted around the piston rod 57 within the lower gun block 52, a seal ring 60 also mounted around the piston rod 57 in the vicinity of the ring plate 59, and a seal ring retainer 61 threaded to the lower gun block 52 so as to retain the seal ring 60 and the ring plate 59 in position within the lower gun block 52.

The applicator nozzle 15 has a fluid passage 67 defined therein across the entire length thereof and has an upper end tightly fitted into a cylindrical hollow in the lower gun block 52 with the fluid passage 67 aligned coaxially with the piston rod 57. This applicator nozzle 15 is retained in position relative to the lower gun block 52 by means of a nut-like fixture 56 firmly threaded onto a lower end of the lower gun block 52 as shown.

A portion of the cylindrical hollow in the lower gun block 52 delimited between the ring plate 59 and an upper end face of the applicator nozzle 15 forms a valve chamber 65 which is fluid connected with the supply tubing 13 through a material supply port 64 defined in the lower gun block 52 in communication therewith. A peripheral lip region of the fluid passage 67 on the upper end face of the applicator nozzle 15 defines a valve seat 66 cooperable with a lower end of the piston rod 57. The vibration sensor 21 is firmly threaded radially inwardly into the lower gun block 52 in the vicinity of the applicator nozzle 15.

While the applicator gun 14 is so constructed as hereinabove described, when and so long as the applicator gun 14 is deactivated with no compressed air supplied into the lower chamber of the cylinder housing 54 through the air supply port 63, the piston 55 is lowered as biased by the compression spring 58 with a lower end of the piston rod 57 consequently seated against the valve seat 66 on the upper end of the applicator nozzle 15 thereby to close the fluid passage 67 as shown in FIG. 3. In this condition, the coating material TZ supplied under pressure into the valve chamber 65 through the material supply port 64 will not flow into the fluid passage 67 in the applicator nozzle 15.

However, when the compressed air is introduced into the lower chamber of the cylinder housing 54, the piston 55 is upwardly shifted against the compression spring 58 with air inside the upper chamber of the cylinder housing 54 vented to the atmosphere through the vent port 62 and, consequently, the piston rod 57 is upwardly shifted with its lower end separating from the valve seat 66 on the upper end of the applicator nozzle 15 thereby to open the fluid passage 67 in the applicator nozzle 15. Thus, it will readily be understood that, when and so long as the applicator gun 14 is activated with the compressed air introduced into the lower chamber of the cylinder housing 54, the coating material TZ supplied into the valve chamber 65 through the material supply port 64 flows into the fluid passage 67 and is hence discharged from a nozzle tip of the applicator nozzle 15 to form the continuous bead BD of coating material.

Figure 2:
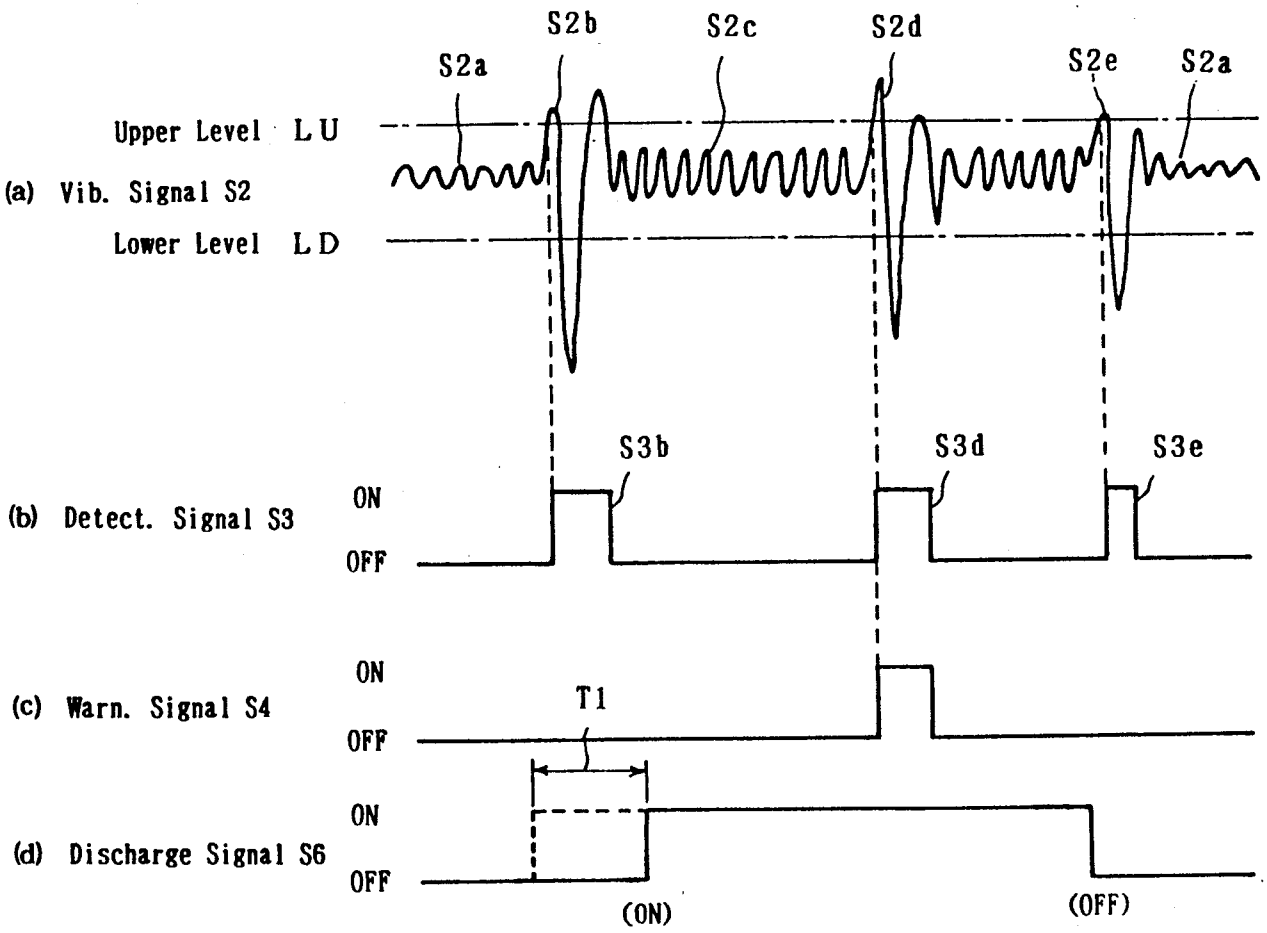
FIG. 2 is a chart showing various signals appearing in the coating system in timed relationship with each other, wherein FIG. 2(*a*) illustrates a waveform of a vibration signal outputted from a low-pass filter shown in FIG. 1, FIG. 2(*b*) illustrates a waveform of a detection signal S3 outputted from a detector shown in FIG. 1, FIG. 2(*c*) illustrates a waveform of a warning signal S4 outputted form an output circuit shown in FIG. 1, and FIG. 2(*d*) illustrates a waveform of a discharge signal S6 used in the coating system.

Referring now to FIG. 2, FIG. 2(*a*) illustrates a waveform of the low frequency vibration signal S2 outputted from the low-pass filter 23; FIG. 2(*b*) illustrates a waveform of the detection signal S3 outputted from the detector 24; FIG. 2(*c*) illustrates a waveform of the warning signal S4 outputted form the output circuit 26; and FIG. 2(*d*) illustrates a waveform of the discharge signal S6 supplied to the output circuit 26.

As shown in FIG. 2(*a*), when and so long as the applicator gun 14 is deactivated, that is, no coating material TZ is discharged from the applicator nozzle 15, only a noise signal component S2*a* is generated indicating the presence of vibrations occuring in the surroundings and also of vibrations peculiar to the computer-assisted manipulator. However, when the valve rod 57 is upwardly shifted as a result of an activation of the pneumatic cylinder 53 with the fluid passage 67 consequently opened in the manner as hereinbefore described, a valving signal component S2*b* is generated indicating the presence of shocks induced by the movement, and the subsequent stoppage, of the valve rod 57 and the discharge of the coating material TZ. Thereafter, a standing signal component S2*c* is generated indicating the normal, stabilized flow of the coating material TZ. If the compressed air mixed up in the coating material is abruptly expanded as the coating material TZ is discharged outwardly from the applicator nozzle 15 in the manner as hereinbefore described, the amplitude of the standing signal component S2*c* undergoes an abrupt change represented by a rupture signal component S2*d* signifying an occurrence of the abrupt expansion of the compressed air contained in the coating material TZ being discharged.

When the supply of the compressed air into the lower chamber of the cylinder housing 54 is interrupted allowing the piston rod 57 to be lowered as biased by the compression spring 58 through the piston 55, resulting in the closure of the fluid passage 67 in the applicator nozzle 15, a closing signal component S2*e* is generated indicating the interruption of discharge of the coating material TZ from the applicator nozzle 15 and, thereafter, the noise signal component S2*a* is again generated.

The reference level signal S5 set by the reference level selector 25 and supplied to the detector 24 contains upper and lower level limits LU and LD. Since the rupture signal component S2*d* deviates from a level range delimited by the upper and lower level limits LU and LD of the reference level signal S5, a detection signal component S3*d* shown in FIG. 2(*b*) is generated in response to the rupture signal S2*d*. Also, since one or both of the valving signal component S2*b* and the closing signal component S2*e* may deviate from the level range delimited by the upper and lower level limits LU and LD, one or both of detection signal components S3*b* and S3*e* may be generated in response to the signal components S2*b* and S2*e*, respectively.

The discharge signal S6 shown in FIG. 2(*d*) and supplied to the output circuit 26 is in the form of a pulse signal which sets up to assume an ON state at a timing delayed a predetermined time T1 from the timing of generation of an activating signal applied to a switching valve to effect the supply of the compression air into the lower chamber of the cylinder housing 54 thereby to shift the piston rod 57 upwardly against the compression spring 58, and sets down to assume an OFF state simultaneously with the timing of generation of a deactivating signal applied to the switching valve to interrupt the supply of the compressed air to the lower chamber of the cylinder housing 54 thereby to shift the piston rod 57 downwardly as biased by the compression spring 58. Since the detection signal S3 is outputted from the output circuit 26 only when the discharge signal S6 is in the ON state, the warning signal S4 is therefore generated in response to the detection signal component S3*d*.

In other words, according to the present invention, the vibration induced by the rupture of the compressed air mixed up in the coating material TZ is detected by the vibration sensor 21 to provide the rupture signal component S2*d* which is in turn detected by the detector 24, said detector 24 subsequently providing the detection signal S3 which is utilized to cause the output circuit 26 to generate the warning signal S4.

As hereinbefore described, this warning signal S4 may be employed to provide an audio and/or visual indication of the occurrence of the bead breakage through any suitable audio/visual indicator and/or to halt the applicator system.

Specifically, the warning signal S4 may be used to cause the computer-assisted manipulator to cease the movement of the applicator gun 14 and/or to generate the audio/visual signal necessary to trigger on the audio/visual indicator calling an attention of the attendant worker to inspect both of the work W and the bead BD of coating material deposited thereon so that the attendant worker can remove the defective work W. The warning signal S4 may also be used to cause the computer-assisted manipulator to perform a re-coating operation so that the discontinued bead on the work can be remedied. In any event, the warning signal S4 may be used in any suitable manner those skilled in the art may wish to use for their intended purpose.

Thus, it will readily be understood that, with the system embodying the present invention, the works of high quality can be processed at a relatively high yield and, where the computer-assisted manipulator is used to move the applicator gun to follow the predetermined path, the reliability of the coating operation performed thereby can also be improved.

It is to be noted that, in the foregoing embodiment, if the reference level selector 25 is adjusted to vary the reference level represented by the reference level signal S5, a varying length of a portion of the bead which has been disrupted can be detected. Depending on the purpose for which the bead of coating material is formed on the work or the type of fluid material used, the breakage of the bead of coating material over a few millimeters, for example, up to about 5 millimeters, may not be deemed as a defect and, therefore, arrangement may be made to provide the rupture signal component S2*d* only when the breakage of the bead occurs over the length greater than about 5 millimeters.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. For example, in the foregoing illustrated embodiment, the system has been described and shown as designed that the warning signal S4 corresponding to the detection signal component S3*d* can be generated during the ON state of the discharge signal S6 and in response to the detection signal S3 from the detector 24. However, the detector 24 may be so designed as to generate the detection signal S3 corresponding only to the rupture signal component S2*d* and the standing signal component S2*c*.

Also, although reference has been made to the use of only the single vibration sensor 21, the number of the vibration sensors utilizable in the practice of the present invention may not be limited to one and two or more vibration sensors may be utilized. Where the plural vibration sensors are employed, they should be fitted to the applicator gun 14 at respective locations adjacent the applicator nozzle 14 and circumferentially equally spaced from each other about the longitudinal axis of the applicator nozzle 15. At the same time, the detector circuit need be so designed that, by summing respective vibration signals outputted from the plural vibration sensors together, the rupture signal components S2*d* and the standing signal components S2*c* both generated from the center of the applicator nozzle 15 can be summed together while the noise signal components S2*a* originating from the surroundings can be subtracted, wherefore the signal-to-noise ratio of any one of each rupture signal component S2*d* and each standing signal S2*c* can be improved.

Again, where at least two vibration sensors are employed, one of them may be used to detect vibrations occurring in the applicator nozzle 15 in a direction parallel to the longitudinal sense of the applicator nozzle 15 while the other of them may be used to detect those occurring in the applicator nozzle 15 in a direction transverse to the longitudinal sense of the applicator nozzle 15.

Furthermore, instead of the detection of the vibrations resulting from the expansion of the compressed air mixed up in the fluid material for the purpose of detecting the occurrence of the breakage of the bead of such fluid material, any other vibrations may be detected. In such case, the use may be made of a piezoelectric element or any other suitable vibration inducing element to apply a vibration of a frequency equal to or generally equal to the frequency of resonance of the applicator gun 14 to the applicator nozzle 15 so that a change in frequency of resonance of a mechanical system of the applicator gun 14, which is indicative of the occurrence of the breakage of the bead, can be detected.

Yet, the inclusion of the compressed air in the fluid material can be detected by analyzing the frequency of the vibration signal S1 generated by the vibration sensor 21.

Finally, the details of the applicator system may not be always limited to those shown and described and may be of any suitable design.

Accordingly, such changes and modifications are, unless they depart from the spirit and scope of the present invention as delivered from the claims annexed hereto, to be construed as included therein.

What is claimed is:

1. A method of detecting a breakage of a bead of fluid material emerging from a nozzle, which comprises the steps of:

providing the nozzle with a vibration sensor;

using the vibration sensor to detect and provide an electric vibration responsive to vibrations occurring in the nozzle; and detecting a change in level of the vibration signal to provide an indication of an occurrence of the breakage of the bead.

2. The method of detecting the bead breakage as claimed in claim 1, wherein said indication is provided when an amplitude level of the vibration signal exceeds a predetermined level.

* * * * *